US006102076A

United States Patent [19]

Romero, Jr. et al.

[11] Patent Number: 6,102,076

[45] Date of Patent: Aug. 15, 2000

[54] EXHAUST PIPE COVER

[76] Inventors: Frank A. Romero, Jr.; Kerri N. Daniels-Romero, both of 1176 Amberton La., Newbury Park, Calif. 91320; Paul C. Lascola, 1705 N. Marian Ave., Thousand Oaks, Calif. 91360

[21] Appl. No.: 09/405,115

[22] Filed: Sep. 27, 1999

[51] Int. Cl.[7] ..... F16L 57/00

[52] U.S. Cl. ..... 138/96 R; 138/110; 138/128; 454/4

[58] Field of Search ..... 138/96 R, 89.4, 138/89.1, 109, 110, 156, 128; 454/4; 60/324

[56] References Cited

U.S. PATENT DOCUMENTS

| | | | |
|---|---|---|---|
| 2,371,913 | 3/1945 | Phillips et al. | 138/96 |
| 2,942,625 | 6/1960 | Costanzo | 138/96 |
| 4,168,726 | 9/1979 | Klennert | 138/96 R |
| 4,930,543 | 6/1990 | Zuiches | 138/110 |
| 4,985,942 | 1/1991 | Shaw | 138/110 X |
| 5,027,862 | 7/1991 | Laybourn | 138/110 X |
| 5,535,787 | 7/1996 | Howell | 138/110 X |
| 5,651,161 | 7/1997 | Asta | 138/110 X |
| 5,687,773 | 11/1997 | Ryan et al. | 138/96 R |
| 5,901,756 | 5/1999 | Goodrich | 138/110 X |

*Primary Examiner*—Patrick Brinson
*Attorney, Agent, or Firm*—Jack C. Munro

[57] ABSTRACT

An exhaust pipe cover that can be placed over the exhaust pipe of a truck or other vehicle that has a vertically oriented exhaust pipe. The purpose of the exhaust pipe cover is to prevent precipitation and dirt from entering into the exhaust pipe during the time that the truck or other vehicle is not being used. The exhaust pipe cover is to utilize a main section which has one end closed and the opposite end open which is to be placeable over the exhaust pipe. This main section can be shortened for shorter length exhaust pipes. This main section can be attached to an extension for longer exhaust pipes. The extension can be shortened by a longitudinally operated drawstring arrangement mounted within the extension so as to customize the cover to precisely the length of exhaust pipes on which it is being used.

9 Claims, 4 Drawing Sheets

EXHAUST PIPE COVER

BACKGROUND OF THE INVENTION

1) Field of the Invention

This invention relates to covers and more particularly to a cover for the vertically oriented exhaust pipe of a truck or other similar type of vehicle which is designed to prevent the entry of precipitation and dirt into the exhaust pipe during the time that the truck is not being operated.

2) Description of the Prior Art

It is exceedingly common for trucks to have vertically oriented exhaust pipes. Vertically oriented exhaust pipes are commonly used in truck tractors which are used to haul trailers. Such trucks are in exceedingly widespread use throughout the world. The vertically oriented exhaust pipes are susceptible to entry by precipitation and dirt when the truck is not being used. In the past, in order to prevent precipitation and dirt from entering into the exhaust pipe, it has been known to place a right-angled bend in the exhaust pipe at its outer end so that access into the exhaust pipe occurs horizontally rather than vertically. This type of structural arrangement of an exhaust pipe will prevent most moisture and dirt from entering the exhaust pipe although some moisture and some dirt is capable of entering it. Also, it has been known to place some kind of a flapper valve on the exhaust pipe that has a tendency to close the opening into the exhaust pipe but is readily pivoted away from the opening of the exhaust pipe during operation of the truck. The problem with these flapper valves is that such produce noise during operation of the truck with this noise normally being undesirable for most people.

There are a substantial number of trucks that have vertically oriented exhaust pipes on which there are no flapper valves and where the exhaust pipe is directed straight upward and does not include a right angled tube at its outer end. It is for these trucks that there is a special need for a cover that can be placed over the exhaust pipe when the truck is not being used to prevent precipitation and dirt from entering the exhaust pipe.

SUMMARY OF THE INVENTION

A cover for an exhaust pipe of a vehicle such as a truck where the exhaust pipe is vertically oriented. The exhaust pipe cover comprises a tubular body which is open at one end and closed at the opposite end with a disengageable longitudinal seam extending from the closed end to the open end. The exhaust pipe is to be placed within the sheet material body. For a shorter length of exhaust pipe, the excess length can be folded over upon itself and connected together by a fastener arrangement. The open end of the body includes a drawstring which is be tightened when mounted about the exhaust pipe. A tubular extension may be connected to the body for longer length exhaust pipes. The tubular extension includes a longitudinal seam which can be disengaged and re-engaged by a further fastener arrangement. The extension includes a longitudinally oriented drawstring arrangement that can be pulled to shorten the extension so as to customize the extension to the precise length of exhaust pipes on which it is being used.

The primary objective of the present invention is to construct a cover for an exhaust pipe which can be placed over the vertically oriented exhaust pipe of a truck to prevent entry of foreign material to within the exhaust pipe when the truck is not being used.

Another objective of the present invention is to construct a cover for an exhaust pipe that can be used on any length of exhaust pipe whether short or long.

Another objective of the present invention is to construct a cover for an exhaust pipe which can be custom designed for the individual length of exhaust pipe on which it is being used.

Another objective of the present invention is to construct a cover for an exhaust pipe which is constructed of exceedingly sturdy waterproof fire retardant material which will be able to be used for a period of years not requiring replacement but yet can be manufactured at a reasonable cost and thereby sold to the ultimate consumer at a reasonable cost.

DETAILED DESCRIPTION OF THE PREFERRED EMBODIMENT

Figure 1:
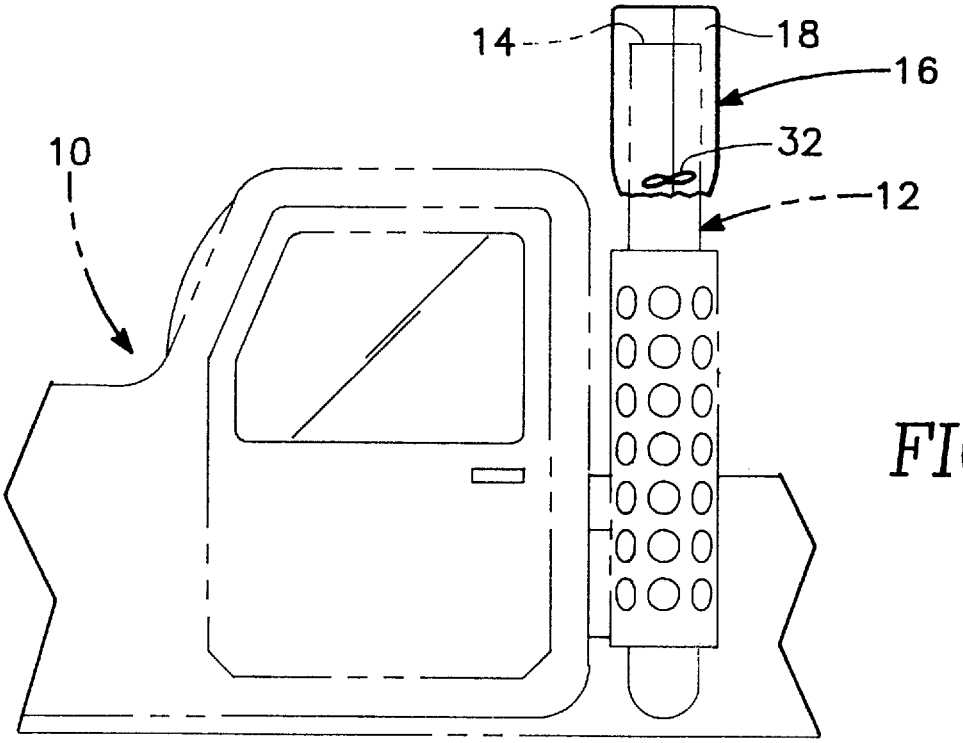
FIG. 1 is a side elevational view of a portion of a truck showing the main section of the cover of the present invention being installed on the exhaust pipe of the truck.

Referring particularly to the drawings, there is shown a portion of the cab 10 of a conventional truck type of vehicle. It is common, in such vehicles, to have a vertically oriented exhaust pipe 12 that is mounted to the rear of the cab 10. This pipe 12 has an open outer end 14. The vertical exhaust pipe 12 has an internal exhausting chamber 13 with this exhausting chamber 13 connecting with the open outer end 14. It is to be understood that during the operation of the truck that exhaust from the engine will be conducted through the internal exhausting chamber 13 and is to be discharged into the atmosphere through the open outer end 14.

Referring particularly to the drawings, there is shown the main section 16 of the cover of this invention. The main section 16 is formed of a sheet material body 18 with a typical material of construction for the body 18 to be a canvas, nylon, or plastic waterproof type of material. The body 18 has a closed end 20 and an open end which forms an access opening 22. Access opening 22 provides access into an internal chamber 24. Closed end 20 defines a lineal seam. Formed within the body 18 is a longitudinal seam 26. The longitudinal seam 26 is located transverse to the lineal seam of the closed end 20 and connects to the closed end 20 at the approximate mid-point of the lineal seam. This lineal seam is to be continuously closed. The longitudinal seam 26 is openable by disengaging a fastening arrangement comprised of hook and eyelet pads 28 and 30 which are mounted on the body 18. It is to be understood that one of the pads would comprise a mass of hooks and the other of the pads would comprise a mass of eyelets so that the two will engage together. However, the fastener pads 44 and 46 are easily separated by exerting a sufficient manual force to separate same.

The pad 28 is mounted on the outer surface of the body 18 at the seam 26 with the pad 30 being mounted on the inside surface of the body 18 at the seam 26. The pads 28 and 30 are to be disengaged which will longitudinally open the body 18 providing access into the internal chamber 24 and the main section 16 is then to be placed over the upper outer end of the exhaust pipe 12 with the exhaust pipe 12 located within the internal chamber 24. The hook and eyelet pads 28 and 30 are then engaged which will completely enclose the upper end of the vertical exhaust pipe 12 by the body 18 of the main section 16. A tightening device, such as a drawstring 32, is mounted within the body 18 directly adjacent the access opening 22. The drawstring 32 can be pulled and tied which will tightly secure the main section 16 onto the vertical exhaust pipe 12.

It is to be noted that the access opening 22 includes an annular strip 34 of either a hook or eyelet fastener pad. This annular strip 34 is to facilitate connection with an opposite configuration of an annular strip 36 of a hook or eyelet fastener pad which is mounted on the upper end of a tubular extension 38. The tubular extension 38, formed of a sheet material fabric, or other sturdy waterproof material, constitutes a tubular type of member that is open at both ends. The tubular extension 38 includes a longitudinal seam 40. The tubular extension 38 has a body 42 with a hook or eyelet fastener pad 44 being mounted on the exterior surface of the body 42 with an opposite configuration of a similar hook and eyelet fastener pad 46 being mounted on the interior surface of the body 42. Both the fastener pads 44 and 46 are located in conjunction with the seam 40. The fastener pads 44 and 46 extend the entire length of the body 42. The annular strip 36, when connecting with the annular strip 34 produces a longer length cover which is composed of the main section 16 and the tubular extension 38. The extension 38 is to be used when the vertical exhaust pipe 12 is of significantly longer length. It is to be understood that these vertical exhaust pipes 12 are also constructed to be attractive in appearance such as being chromed or gold and therefor the cover of the present invention can be used to protect that exterior appearance.

Figure 6:
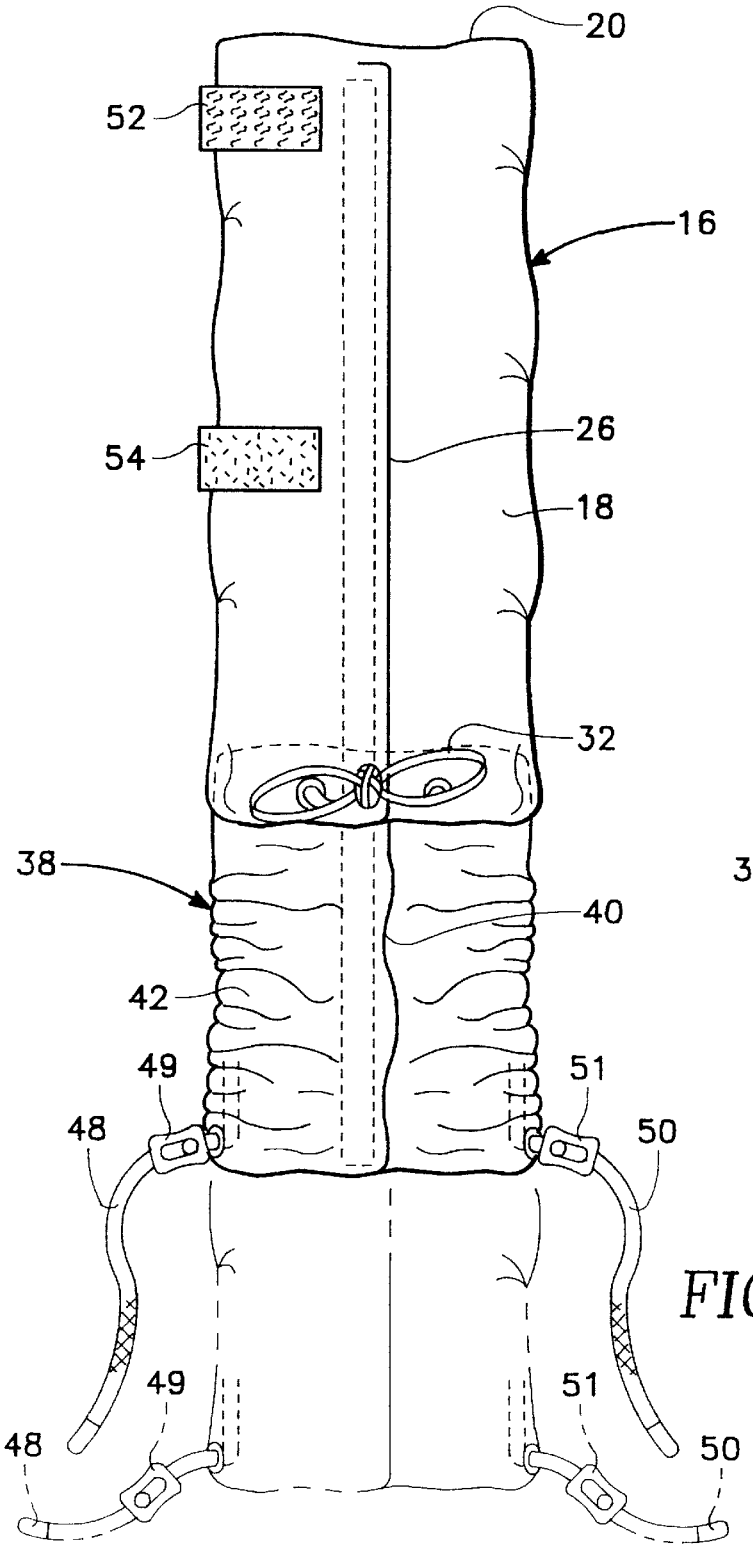
FIG. 6 is a view similar to FIG. 3 but showing the tubular extension being shortened in length so as to accommodate to a longer length exhaust pipe but where the exhaust pipe is longer than the main section requiring that the tubular extension be shortened in length.
Figure 7:
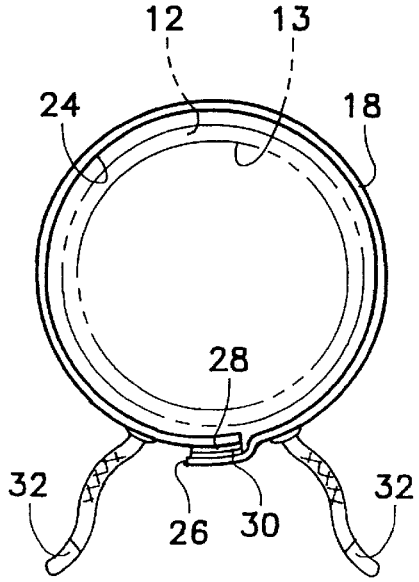
FIG. 7 is a cross-sectional view taken along line 7—7 of FIG. 4 showing in greater detail the main section as it is mounted on the vertical exhaust pipe.

Normally, the main section 16 will be designed to be about two feet in length. The tubular extension 38 may be designed to be about eight feet in length. Some vertical exhaust pipes 12 are some distance greater than the two feet but less than ten feet. In such an instance, the user can custom design the length of the tubular extension 38 by pulling on drawstrings 48 and 50. The drawstrings 48 and 50 are mounted within the body 42 and located diametrically opposite to each other. The inner ends of the drawstrings 48 and 50 are fixedly attached to the body at the end of the body 42 that contains the annular strip 36. At the opposite end of the body 42, the drawstrings 48 and 50 are movable and by pulling on the drawstrings 48 and 50 will cause the fabric of the body 42 to crinkle, as is clearing shown in FIG. 6 of the drawings. This crinkling of the body 42 will cause the body 42 to be shortened and it is to be shortened to cover the precise length of the vertical exhaust pipe 12 on which it is being installed. Once the length has been established by the pulling on the drawstrings 48 and 50, the drawstrings 48 and 50 should never again need to be operated as the body 42 will remain in its established crinkled position even during times when the tubular extension 38 is placed on and taken off and replaced on to the exhaust pipe 12. The drawstrings 48 and 50 each include a lock 49 and 51 respectively which are to be moved relative to their respective drawstrings 48 or 50 to be located next to body 42. The locks 49 and 51 establish a snug frictional connection with their respective drawstrings 48 and 50 to prevent inward movement of the drawstrings 48 and 50 which would cause the tubular extension to extend.

Normally, when installing of the tubular extension 38 onto the vertical exhaust pipe 12, it will be attached with annular strip 36 being attached to annular strip 34. Then as a single unit the tubular extension 38 and the main section 16 is to be installed on the vertical exhaust pipe 12 with fastener pads 44 and 46 disengaged and fastener pads 28 and 30 disengaged. Once the tubular extension 38 and the main section 16 are installed on the exhaust pipe 12, the fastener pads 28 and 30 are engaged and then fastener pads 44 and 46 are engaged. Then drawstring 32 is to be tied, as previously discussed.

Figure 2:
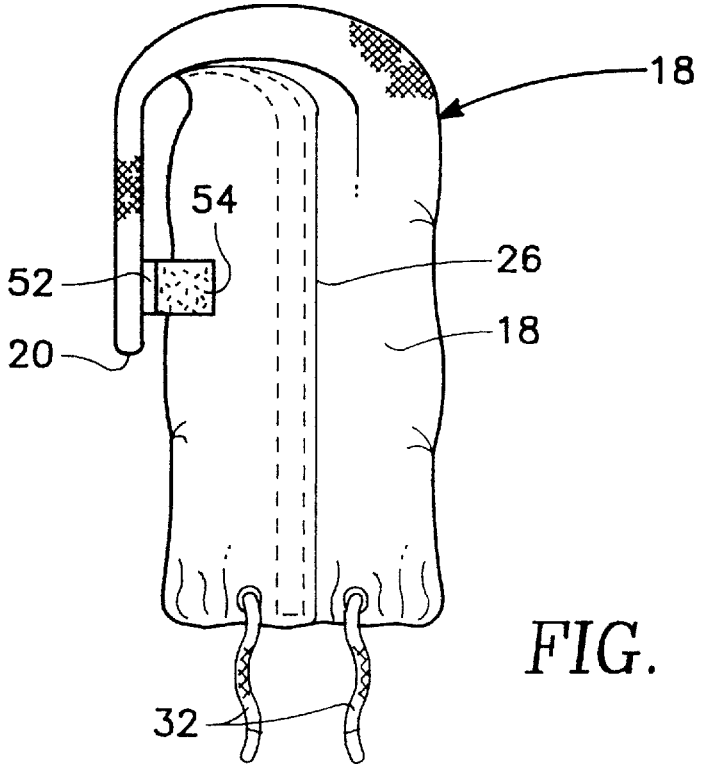
FIG. 2 is an isometric view showing the main section of the cover of the present invention in a position to accommodate an exceedingly short length of exhaust pipe.
Figure 3:
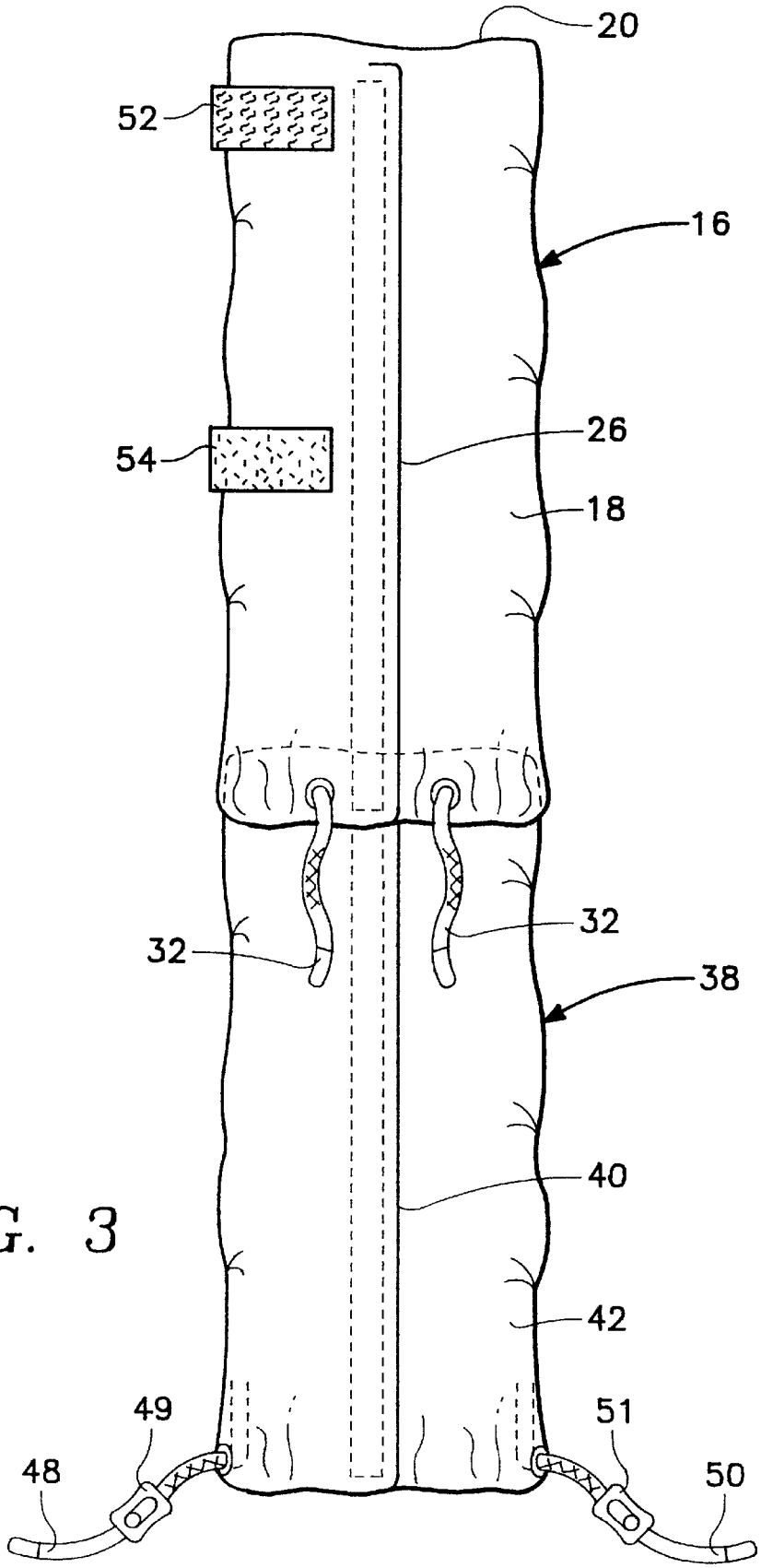
FIG. 3 is a side elevational view showing the main section of the cover for the exhaust pipe which is connected to a tubular extension for a long length of exhaust pipe.
Figure 5:
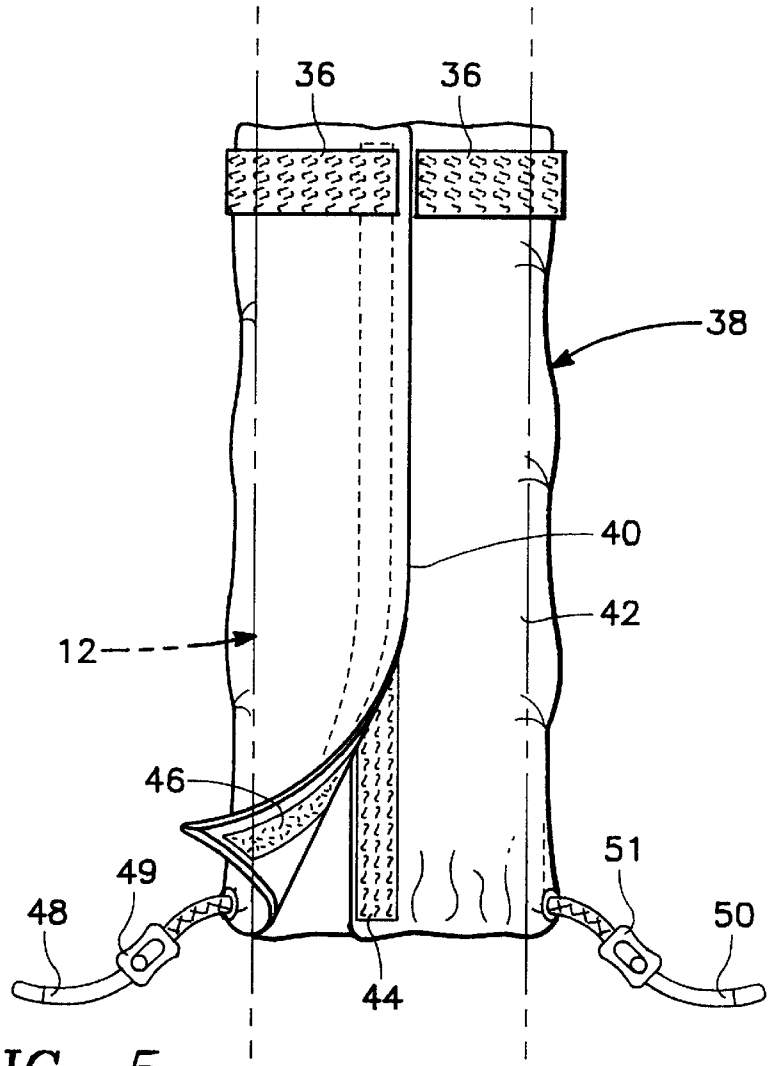
FIG. 5 is a side elevational view of the tubular extension which is to be used for long length of exhaust pipes and is to be attached to the main section of the present invention.
Figure 4:
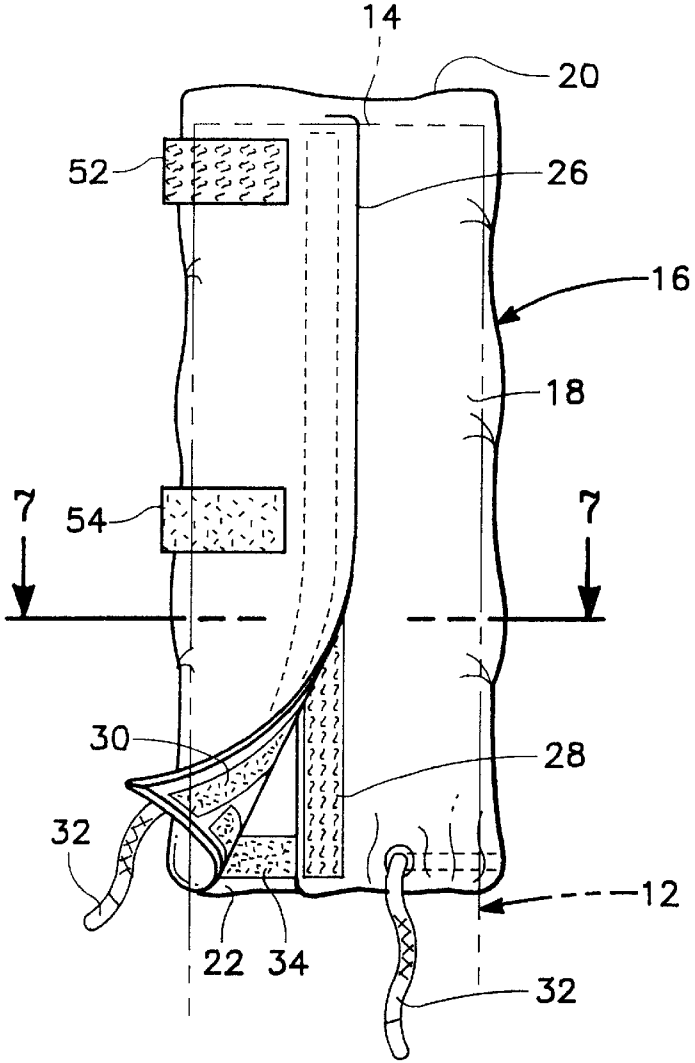
FIG. 4 is a side elevational view of the main section of the cover of the present invention which is shown in a partially open position.

At times, there are exhaust pipes 12 that are exceedingly short in length, such as about one foot. With such a short length of exhaust pipe 12, it is only necessary to utilize the main section 16. However, the main section 16 is actually about one foot too long. In such an instance, the main section 16 can be shortened by being folded over upon itself, as is shown in FIG. 2 of the drawings. Mounted on the exterior surface of the body 18 are a pair of spaced apart fastener pads 52 and 54. The unused upper portion of the main section 16 is to be folded over upon itself with the fastener pads 52 and 54 engaging which will then accommodate the main section 16 to the exceedingly short version of vertical exhaust pipe 12.

What is claimed is:

1. An exhaust pipe cover for a vehicle which has a vertical oriented exhaust pipe comprising:

a main section having a sheet material body being open at one end and closed at a closed end which is opposite said open end forming a tubular configuration, said body having an internal compartment;

a first longitudinal seam formed within said body, said seam extending from directly adjacent said closed end to said open end, said first longitudinal seam including a first fastening means, said first longitudinal seam being openable providing access into said internal compartment, said first longitudinal seam being closable by said first fastening means preventing access into said internal compartment; and tightening means connecting with said open end, said open end having an access opening providing access into said internal compartment, said tightening means being manually movable to diminish the size of said access opening, whereby said first longitudinal seam is to be open permitting insertion of the outer portion of a vehicle exhaust pipe within said internal compartment and then closing said first longitudinal seam by said first fastening means and then operating of said tightening means to tightly secure said body to the exhaust pipe.

2. The exhaust pipe cover as defined in claim 1 wherein: said body being constructed of a waterproof fabric.

3. The exhaust pipe cover as defined in claim 1 wherein: said closed end forming a lineal seam, said first longitudinal seam connecting transversely with said lineal seam at the approximate mid-point of said lineal seam.

4. The exhaust pipe cover as defined in claim 1 wherein: said tightening means comprising a drawstring.

5. The exhaust pipe cover as defined in claim 1 including:

a second fastening means formed on the exterior surface of said body, engagement of said fastening means results in said body being reduced in length thereby permitting said body to be mounted on a short length of exhaust pipe.

6. The exhaust pipe cover as defined in claim 5 wherein:

a third fastening means being mounted at said access opening, said third fastening means to be engageable with a tubular extension, whereby said extension in combination with said main section to be usable as a cover for a longer length of exhaust pipe.

7. The exhaust pipe cover as defined in claim 6 wherein:

said tubular extension including a second longitudinal seam, said tubular extension having a first end which is connectable with said body and a second end which is located spaced from said body, said second longitudinal seam extending entirely from said first end to said second end, said second longitudinal seam including a fourth fastening means, said second longitudinal seam being openable providing access into a second internal compartment located within said tubular extension, said second longitudinal seam being closable by said fourth fastening means preventing access into said second internal compartment.

8. The exhaust pipe cover as defined in claim 7 wherein:

said tubular extension including a pair of longitudinal drawstrings which permits said tubular extension to be decreased in length so as to be custom designed to the precise length of the exhaust pipe on which it is mounted.

9. The exhaust pipe cover as defined in claim 8 wherein:

said second longitudinal seam to be aligned with said first longitudinal seam.

* * * * *